United States Patent [19]

Evans

[11] 3,946,978

[45] Mar. 30, 1976

[54] CURTAIN ROD MOUNTING DEVICE

[75] Inventor: William D. Evans, Plains, Mont.

[73] Assignee: The Raymond Lee Organization, Inc., New York, N.Y. ; a part interest

[22] Filed: May 27, 1975

[21] Appl. No.: 581,354

[52] U.S. Cl. ..... 248/264; 16/94 D

[51] Int. Cl.[2] ..... A47H 1/122

[58] Field of Search ..... 16/94 D; 211/105.1, 105.2, 211/105.6; 248/264, 265, 256, 257, 258, 269, 270, 282, 276

[56] References Cited

UNITED STATES PATENTS

| | | | |
|---|---|---|---|
| 1,189,763 | 7/1916 | White | 248/257 |
| 1,712,834 | 5/1929 | McClure | 248/256 |
| 2,138,507 | 11/1938 | Pisciotta | 248/256 |
| 2,435,109 | 1/1948 | Wadkins | 211/105.2 |
| 3,079,005 | 2/1963 | Bednar | 211/105.1 |

*Primary Examiner*—Andrew V. Kundrat
*Attorney, Agent, or Firm*—Daniel Jay Tick

[57] ABSTRACT

A window plate member is affixed to an inside surface of a window casing. An elevating plate member has a lower end hingedly affixed to the window plate member and extending upward from the window plate member to an area above the window casing for rotation from a position closely adjacent the surface of a wall in which the window casing is mounted to a position perpendicular to such surface. A rod connecting member comprises a rod of U-shape having a pair of legs. A first free end of the rod extends at right angles to the plane of the legs and is pivotally mounted on the upper end of the elevating plate member in a manner whereby the legs are movable in a plane perpendicular to the surface of the wall. The rod has a second free end in the plane of the legs for accommodating a tubular curtain rod.

3 Claims, 2 Drawing Figures

CURTAIN ROD MOUNTING DEVICE

DESCRIPTION OF THE INVENTION

The present invention relates to a curtain rod mounting device. More particularly, the invention relates to a curtain rod mounting device for affixing a curtain rod to an inside surface of a window casing mounted in a wall and positioning the rod above the window casing.

Objects of the invention are to provide a curtain rod mounting device of simple structure, which is inexpensive in manufacture, installed with facility and convenience on a solid window casing so that it is securely supported and eliminates the need for being affixed to a plaster or plasterboard wall, in which case it constantly pulls loose and rips large pieces out of the wall, besides being a danger to people, and especially small children and pets, who may be struck by the curtain rod when it falls off the wall, and functions efficiently, effectively and reliably to support a curtain rod and curtain in a completely secure manner and in a manner in which the curtain hides the curtain rod mounting device.

Figure 1:
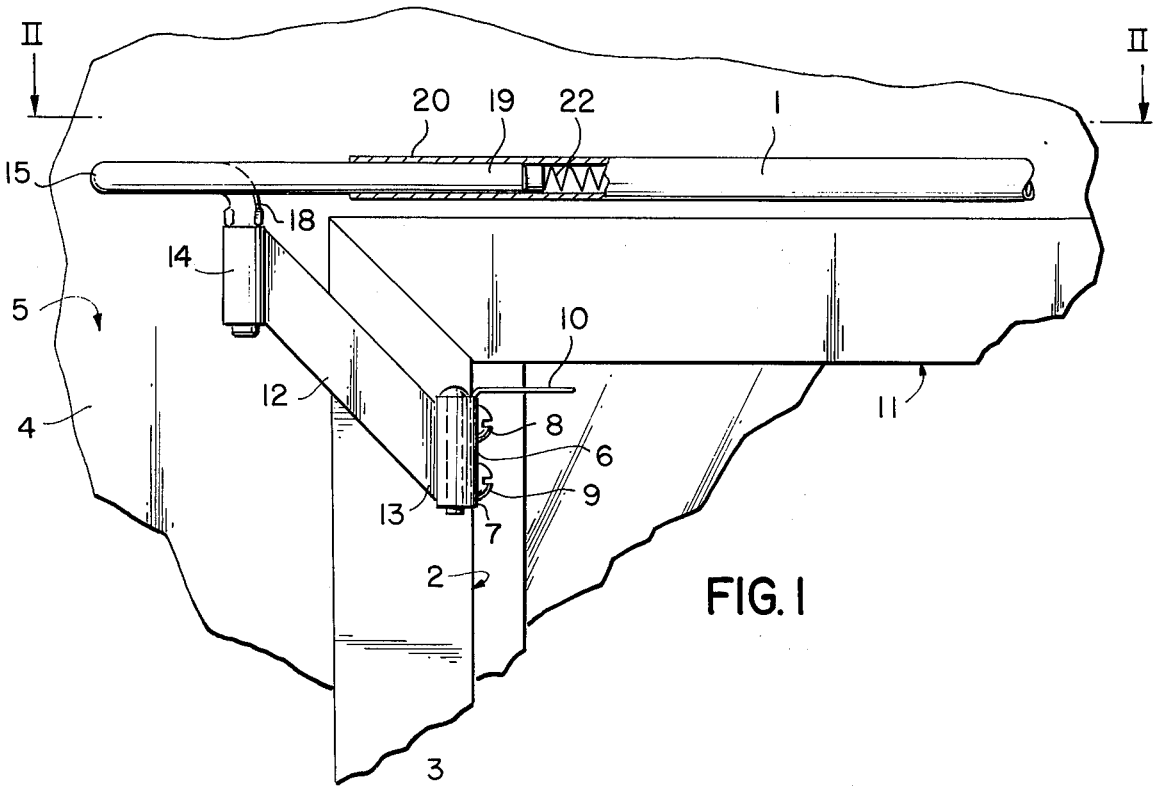
Figure 2:
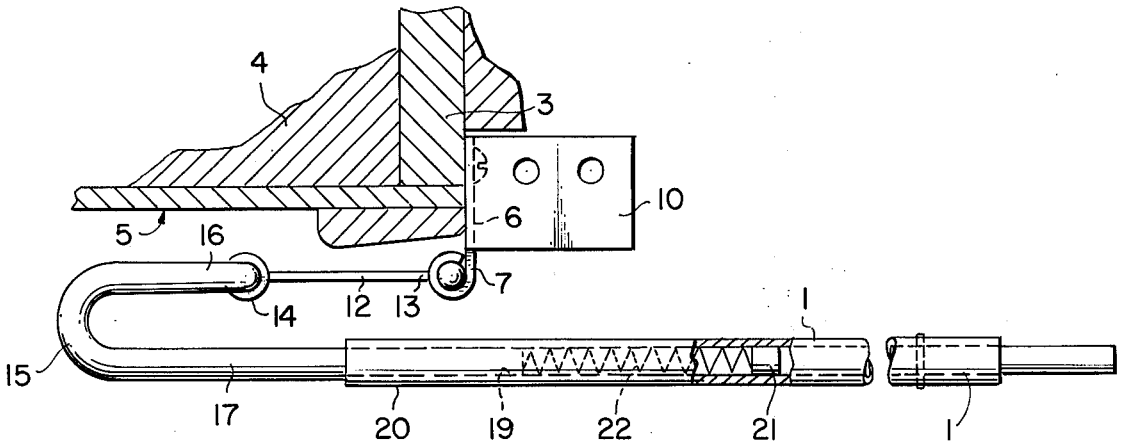

In order that the invention may be readily carried into effect, it will now be described with reference to the accompanying drawing, wherein:

FIG. 1 is a partly cut away, partly sectional view, of an embodiment of the curtain rod mounting device of the invention mounted on a window casing; and FIG. 2 is a view, partly cut away and partly in section, taken along the lines II—II, of FIG. 1.

The curtain rod mounting device of the invention is for affixing a curtain rod 1 of substantially tubular configuration to an inside surface 2 (FIG. 1) of a window casing 3 mounted in a wall 4 having a surface 5. The curtain rod mounting device of the invention positions the rod 1 above the window casing 3, as shown in FIG. 1.

The curtain rod mounting device of the invention comprises a window plate member 6 affixed to the inside surface 2 of the window casing 3. The window plate member 6 comprises a first plate-like part 7 affixed to the inside surface 2 of the window casing 3 by any suitable means such as, for example, screws 8 and 9, and a second plate-like part 10 extending from the first part at substantially right angles therefrom. The second plate-like part 10 may be affixed to an inside surface 11 of the window casing 3, instead of, or in conjunction with, the affixing of the plate-like part 7 to the inside surface 2, if desired.

An elevating plate member 12 has a lower end 13 hingedly affixed to the window plate member 6. The elevating plate member 12 extends upward from the window plate member 6 to an area above the window casing 3 for rotation from a position closely adjacent the surface 5 of the wall in which the window casing 3 is mounted, as shown in FIGS. 1 and 2, to a position substantially perpendicular to said surface. The elevating plate member 12 has an upper end 14.

A rod connecting member 15 comprises a rod of substantially U-shape having a pair of legs 16 and 17 (FIG. 2). A first free end 18 of the rod connecting member 15 extends at substantially right angles to the plane of the legs 16 and 17 (FIG. 1) and is pivotally mounted on the upper end 14 of the elevating plate member 12 in a manner whereby the legs 16 and 17 are movable in a plane substantially perpendicular to the surface 5 of the wall 4. The rod connecting member has a second free end 19 in the plane of the legs 16 and 17 for accommodating the tubular curtain rod 1. That is, one end 20 of the curtain rod 1 is positioned on and around the free end 19 of the rod connecting member 15.

A plug 21 (FIG. 2) is fixed in the curtain rod 1 at a predetermined distance from the end 20 of said curtain rod. A spring 22 is positioned in the curtain rod 1 and extends between the plug 21 and the second free end 19 of the rod connecting member 15, as shown in FIGS. 1 and 2.

While the invention has been described by means of a specific example and in a specific embodiment, I do not wish to be limited thereto, for obvious modifications will occur to those skilled in the art without departing from the spirit and scope of the invention.

I claim:

1. A curtain rod mounting device for affixing a curtain rod to an inside surface of a window casing mounted in a wall having a surface and positioning the rod above the window casing, said mounting device comprising a window plate member affixed to an inside surface of a window casing;

an elevating plate member having a lower end hingedly affixed to the window plate member and extending upward from the window plate member to an area above the window casing for rotation from a position closely adjacent the surface of a wall in which the window casing is mounted to a position substantially perpendicular to said surface, said elevating plate member having an upper end; and a rod connecting member comprising a rod of substantially U-shape having a pair of legs, a first free end extending at substantially right angles to the plane of the legs pivotally mounted on the upper end of the elevating plate member in a manner whereby the legs are movable in a plane substantially perpendicular to the surface of the wall, and a second free end in the plane of the legs for accommodating a substantially tubular curtain rod.

2. A curtain rod mounting device as claimed in claim 1, further comprising a substantially tubular curtain rod having one end seated on the second free end of the rod connecting member, a plug fixed in the curtain rod at a predetermined distance from the one end thereof and a spring in the curtain rod extending between the plug and the second free end of the rod connecting member.

3. A curtain rod mounting device as claimed in claim 1, wherein the window plate member comprises a first plate-like part affixed to an inside surface of a window casing and a second plate-like part extending from the first part at substantially right angles therefrom.

* * * * *